US010584666B2

(12) United States Patent
Murphy et al.

(10) Patent No.: US 10,584,666 B2
(45) Date of Patent: Mar. 10, 2020

(54) INTEGRATED PCV SYSTEM

(71) Applicants: Neil A Murphy, White Lake, MI (US); Timothy R Snyder, Livonia, MI (US)

(72) Inventors: Neil A Murphy, White Lake, MI (US); Timothy R Snyder, Livonia, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 16/027,489

(22) Filed: Jul. 5, 2018

(65) Prior Publication Data

US 2019/0010901 A1 Jan. 10, 2019

Related U.S. Application Data

(60) Provisional application No. 62/530,545, filed on Jul. 10, 2017.

(51) Int. Cl.

| | |
|---|---|
| ***F02M 35/10*** | (2006.01) |
| ***F02M 35/104*** | (2006.01) |
| ***F01M 13/00*** | (2006.01) |
| ***F01M 13/02*** | (2006.01) |

(52) U.S. Cl.

CPC ..... *F02M 35/10222* (2013.01); *F01M 13/00* (2013.01); *F01M 13/022* (2013.01); *F02M 35/104* (2013.01); *F02M 35/10268* (2013.01); *F01M 2013/0038* (2013.01)

(58) Field of Classification Search

CPC . F02M 35/10; F02M 35/104; F02M 35/10026
See application file for complete search history.

(56) References Cited

U.S. PATENT DOCUMENTS

| | | | | |
|---|---|---|---|---|
| 6,234,154 | B1 | 5/2001 | Spix | |
| 7,827,973 | B2 | 11/2010 | Vichinsky | |
| 8,813,728 | B2 * | 8/2014 | Wong | F02B 29/0462 123/184.21 |
| 9,556,767 | B2 | 1/2017 | Newman et al. | |
| 9,890,692 | B1 * | 2/2018 | Turnage | F02B 29/045 |
| 2012/0167860 | A1 * | 7/2012 | Wong | F02B 29/0462 123/542 |

* cited by examiner

*Primary Examiner* — Long T Tran
(74) *Attorney, Agent, or Firm* — Ralph E Smith

(57) ABSTRACT

An intake manifold assembly for a vehicle engine includes an intake manifold housing defining a main chamber having perimeter walls and an open upper end; a charge air cooler (CAC) positioned in the main chamber and having an upper cover plate defining a sealing flange; and an integrated positive crankcase ventilation (PCV) system. The PCV system includes a PCV chamber integrally formed into an upper surface of one of the perimeter walls, the PCV chamber having an open upper end; a PCV port integrally formed with the intake manifold housing and in fluid communication with the PCV chamber; a distribution port defined by a wall of the PCV chamber and in fluid communication with an outlet plenum of the intake manifold. Upon securing the CAC to the intake manifold housing, the CAC sealing flange provides a sealed closure for the intake manifold main chamber and the PCV chamber.

8 Claims, 7 Drawing Sheets

INTEGRATED PCV SYSTEM

CROSS-REFERENCE TO RELATED APPLICATION

This application claims benefit of U.S. Provisional Application Ser. No. 62/530,545 filed on Jul. 10, 2017. The disclosure of the above application is incorporated herein by reference in its entirety.

FIELD

The present application relates generally to positive crankcase ventilation (PCV) arrangements for engines and, more particularly, to a PCV system integrated into an intake manifold where a sealing flange of an associated charge air cooler (CAC) forms a closure for an integrated PCV manifold chamber.

BACKGROUND

Conventional internal combustion engines include positive crankcase ventilation (PCV) systems that typically include a PCV port in the zip tube between the throttle body and the intake manifold chamber. For some engines, the zip tube is not long enough to provide for a desired distribution of PCV air pressure evenly into the combustion chambers. In such a scenario, an attachment PCV system is often utilized, which increases the cost and complexity of the engine assembly, as well as provides for potential additional leak paths. Further, such an attachment system requires additional packaging space, which is typically at a premium in the under hood area of the vehicle. Thus, while such conventional PCV systems do work well for their intended purpose, there remains a need for improvement in the relevant art.

SUMMARY

According to one example aspect of the invention, an intake manifold assembly for an engine of a vehicle is provided. In one exemplary implementation, the intake manifold assembly includes an intake manifold, a charge air cooler (CAC), and an integrated positive crankcase ventilation system. The intake manifold includes a housing defining a main chamber having perimeter walls, a closed bottom end and an open upper end. The CAC is positioned in the main chamber, and includes an upper cover plate defining a sealing flange. The integrated PCV system, includes a PCV chamber, a PCV port and a distribution port. The PCV chamber is integrally formed into an upper surface of one of the perimeter walls, and has an open upper end at the upper surface of the one or more perimeter walls. The PCV port is integrally formed with the intake manifold housing and is in fluid communication with the PCV chamber. The distribution port is defined by a wall of the PCV chamber and is in fluid communication with an outlet plenum of the intake manifold. Upon securing the CAC to the intake manifold housing, the sealing flange provides a sealed closure for the intake manifold main chamber and the PCV chamber.

In some implementations, the PCV port is in direct fluid communication with the PCV chamber and the PCV chamber is in direct fluid communication with the distribution port.

In some implementations, the distribution port is in direct fluid communication with the outlet plenum.

In some implementations, the PCV chamber includes two distribution ports, each of a different diameter for evenly routing PCV gas to the intake runners of the intake manifold.

In some implementations, the upper cover plate and sealing flange are integrally formed with the CAC as a one-piece unit.

In some implementations, the intake manifold assembly further comprises a connection for a zip tube, which is on an opposite side of the intake manifold housing as the integrated PCV system.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

As briefly mentioned above, conventional internal combustion engines include positive crankcase ventilation (PCV) systems that typically include a PCV port in the zip tube between the throttle body and the intake manifold chamber. For some engines, the zip tube is not long enough to provide for a desired distribution of PCV gases evenly into the combustion chambers. In such a scenario, an attachment PCV system is often utilized, which increases the cost and complexity of the engine assembly, as well as provides for potential additional leak paths. Further, such an attachment system requires additional packaging space, which is typically at a premium in the under hood area of the vehicle.

Accordingly, an integrated PCV system is provided. In one example implementation and as will be discussed in greater detail below, the integrated PCV system is integrated into an intake manifold assembly where a PCV channel or manifold is formed in the intake manifold housing and a sealing flange of a top plate of a charge air cooler (CAC) forms a closure of the PCV manifold channel and the intake manifold when the CAC is assembled onto the intake manifold.

With initial general reference to FIGS. 1-7 of the drawings, an exemplary intake manifold assembly 10 is shown that includes an intake manifold 14, a charge air cooler (CAC) 18 and the integrated PCV system 22. In one exemplary implementation and as discussed in greater detail below, the CAC 18 is inserted into the main chamber of the intake manifold 14 and the sealing surface and/or flange of the top plate of the CAC 18 forms a sealed closure of the intake manifold and the integrated PCV system 22.

Figure 1:
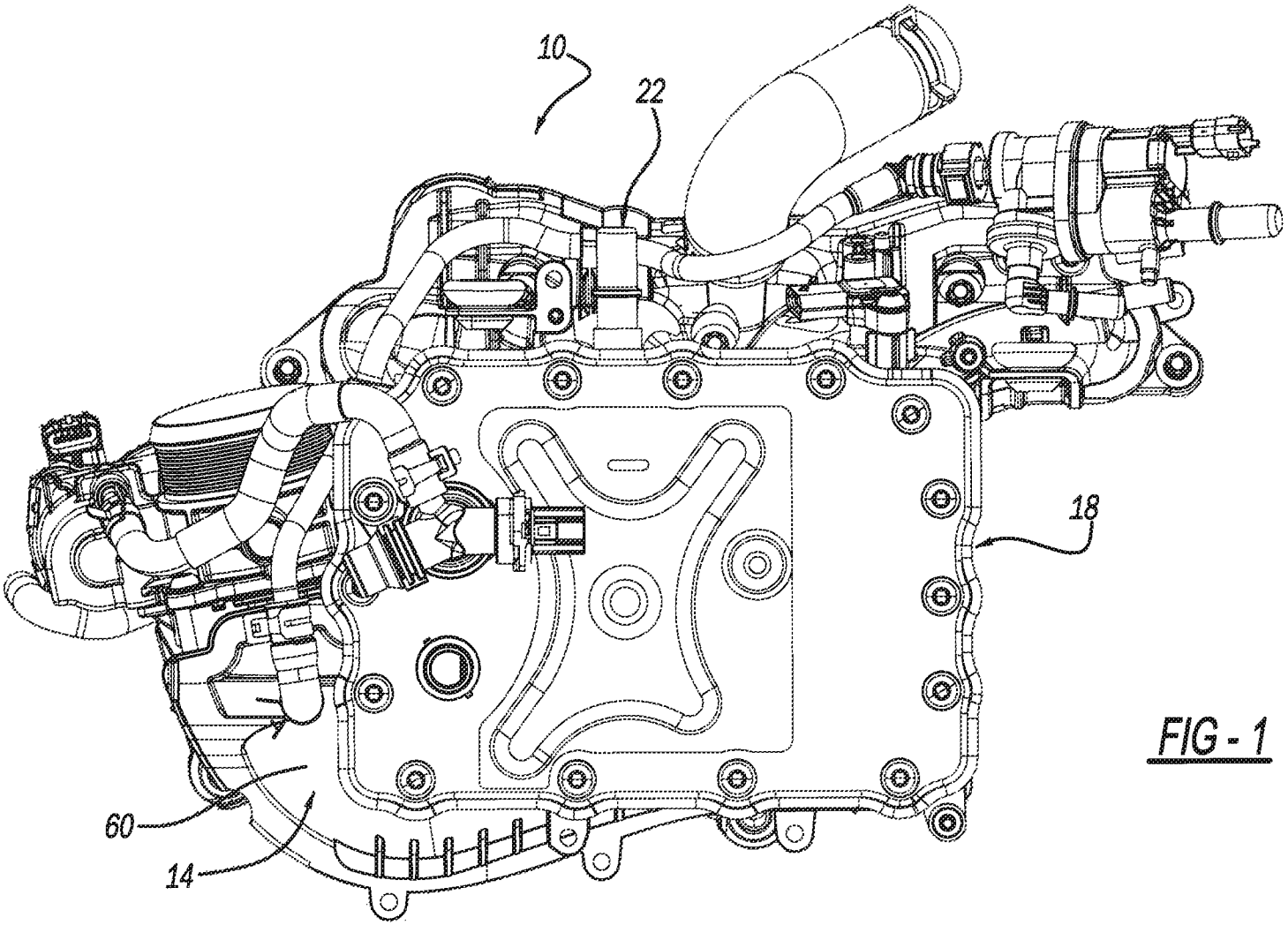
FIG. 1 is a view of an example intake manifold assembly, where the assembly includes a charge air cooler (CAC) and an integrated positive crankcase ventilation (PCV) system in accordance with the principles of the present application.
Figure 2:
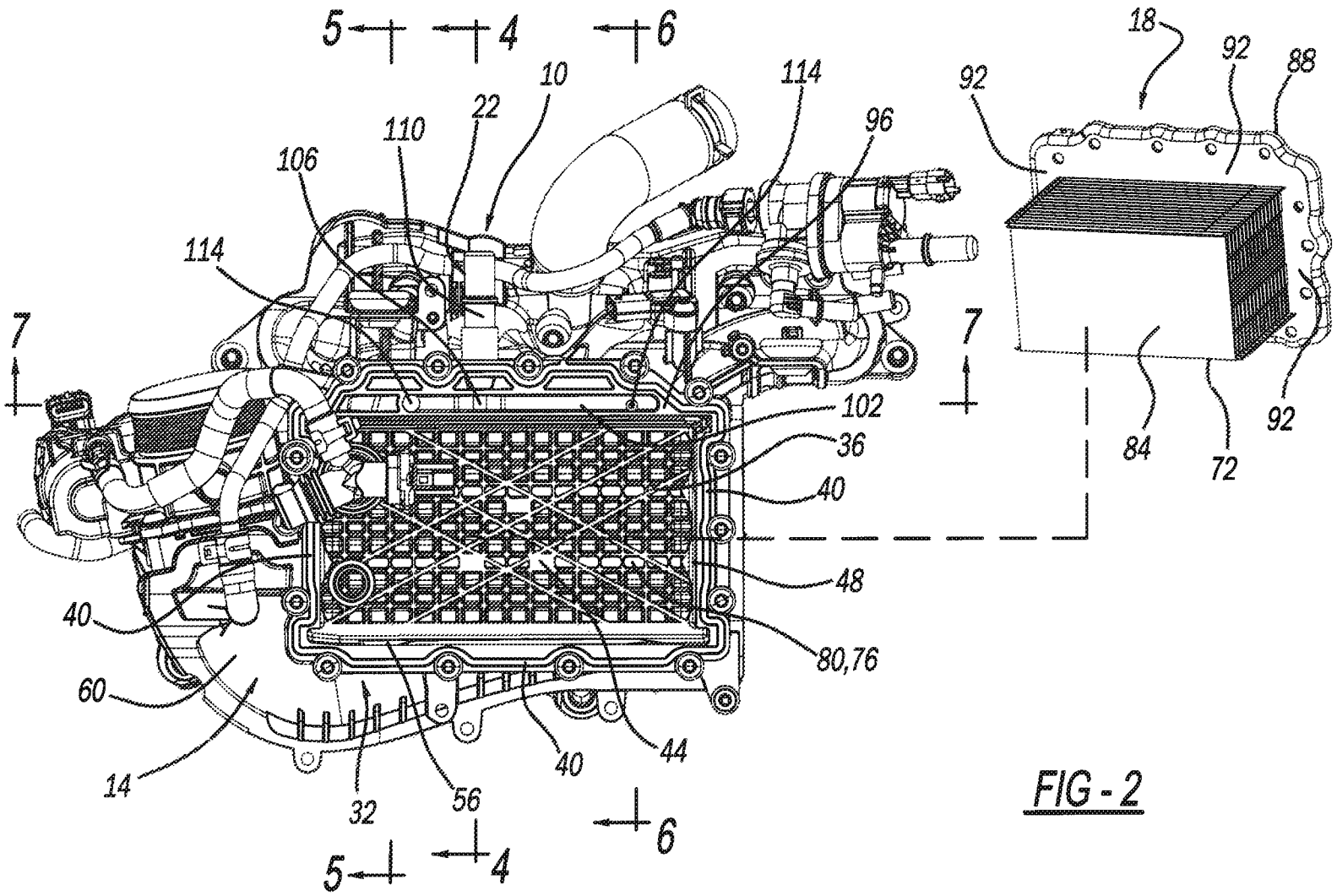
FIG. 2 is a view of the intake manifold assembly of FIG. 1 with the CAC removed in accordance with the principles of the present application.
Figure 3:
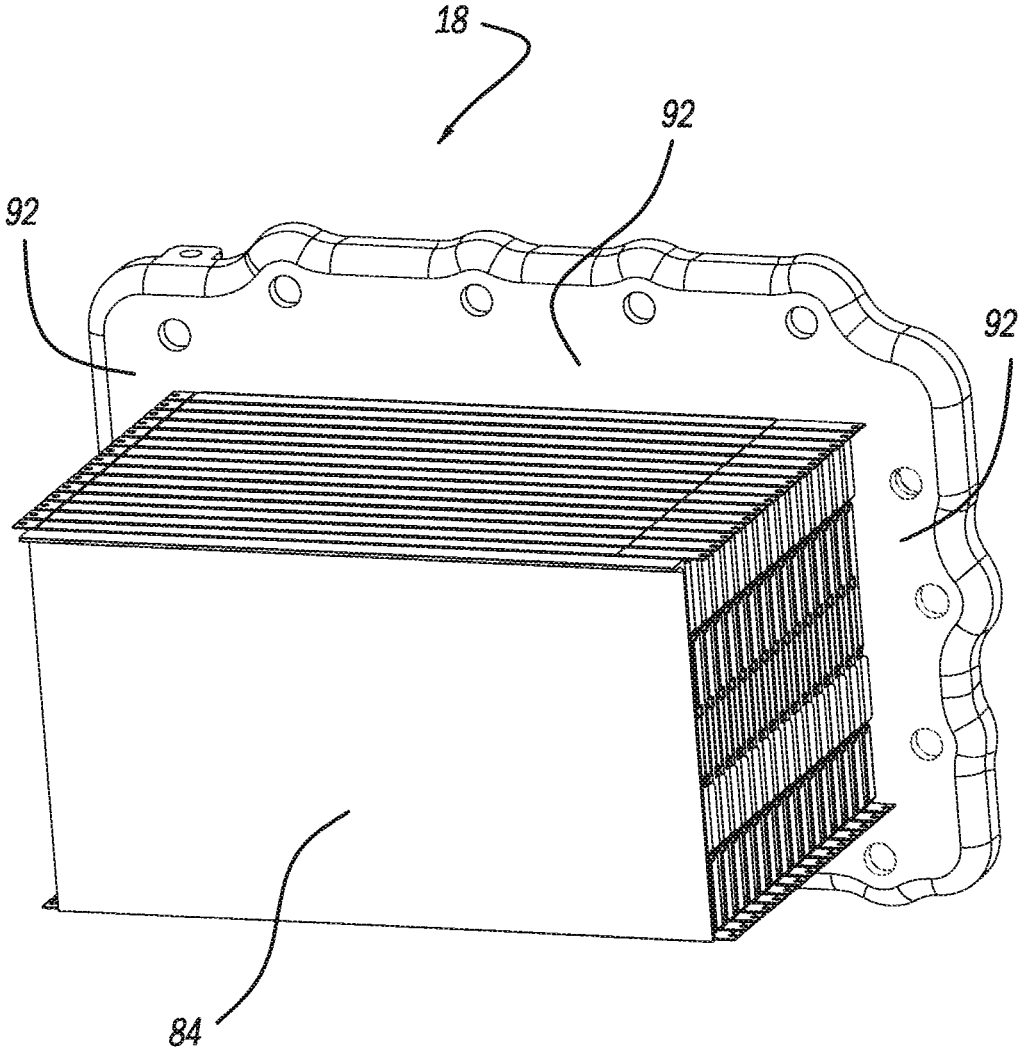
FIG. 3 is a bottom perspective view of an example CAC and its associated cover plate and sealing flange in accordance with the principles of the present application.
Figure 4:
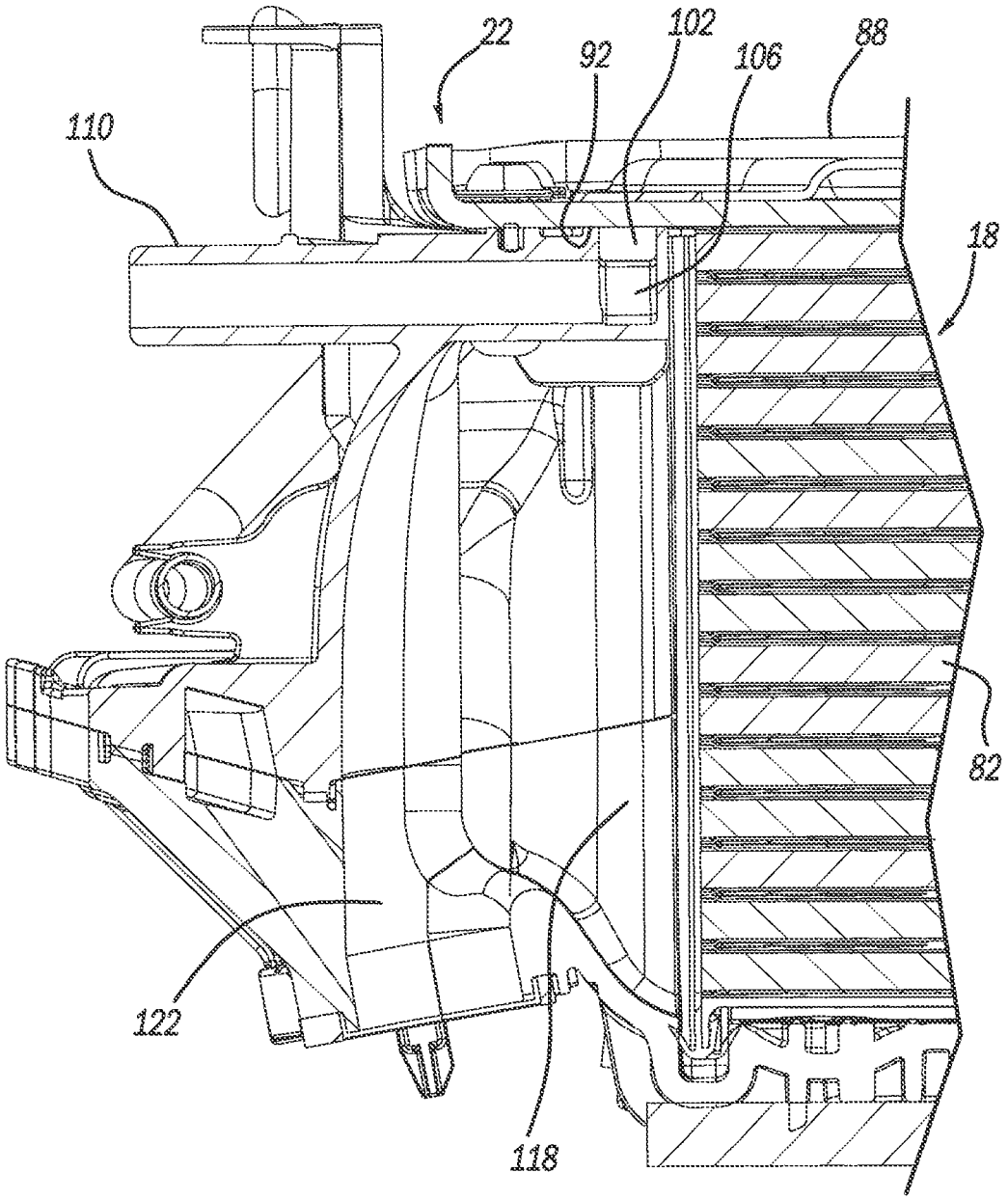
FIG. 4 is a partial sectional view taken along a section through the PCV port, PCV manifold and CAC top plate and sealing flange in accordance with the principles of the present application.
Figure 5:
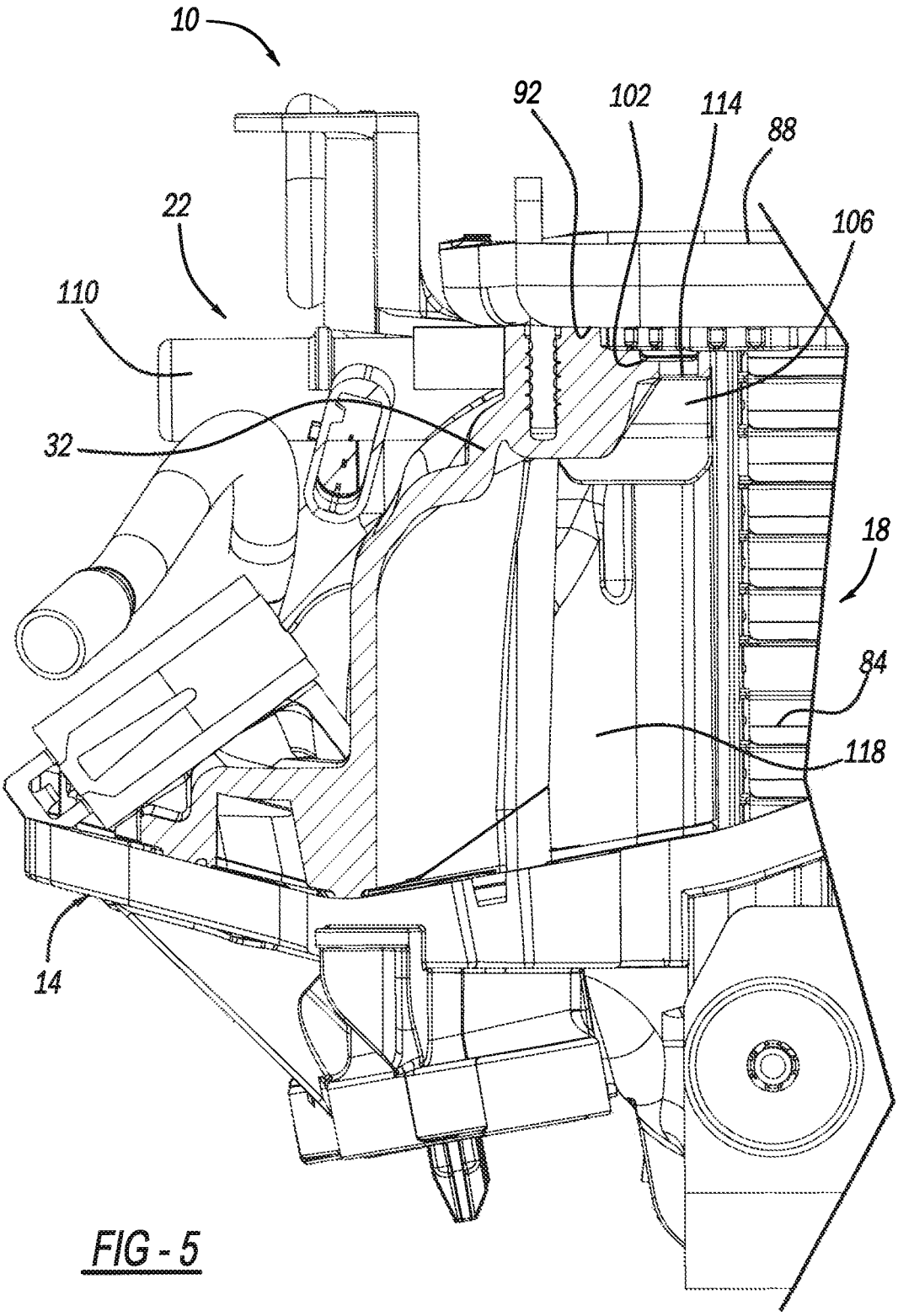
FIG. 5 is another partial sectional view taken along a section through a PCV distribution hole, PCV manifold and CAC top plate and sealing flange in accordance with the principles of the present application.
Figure 6:
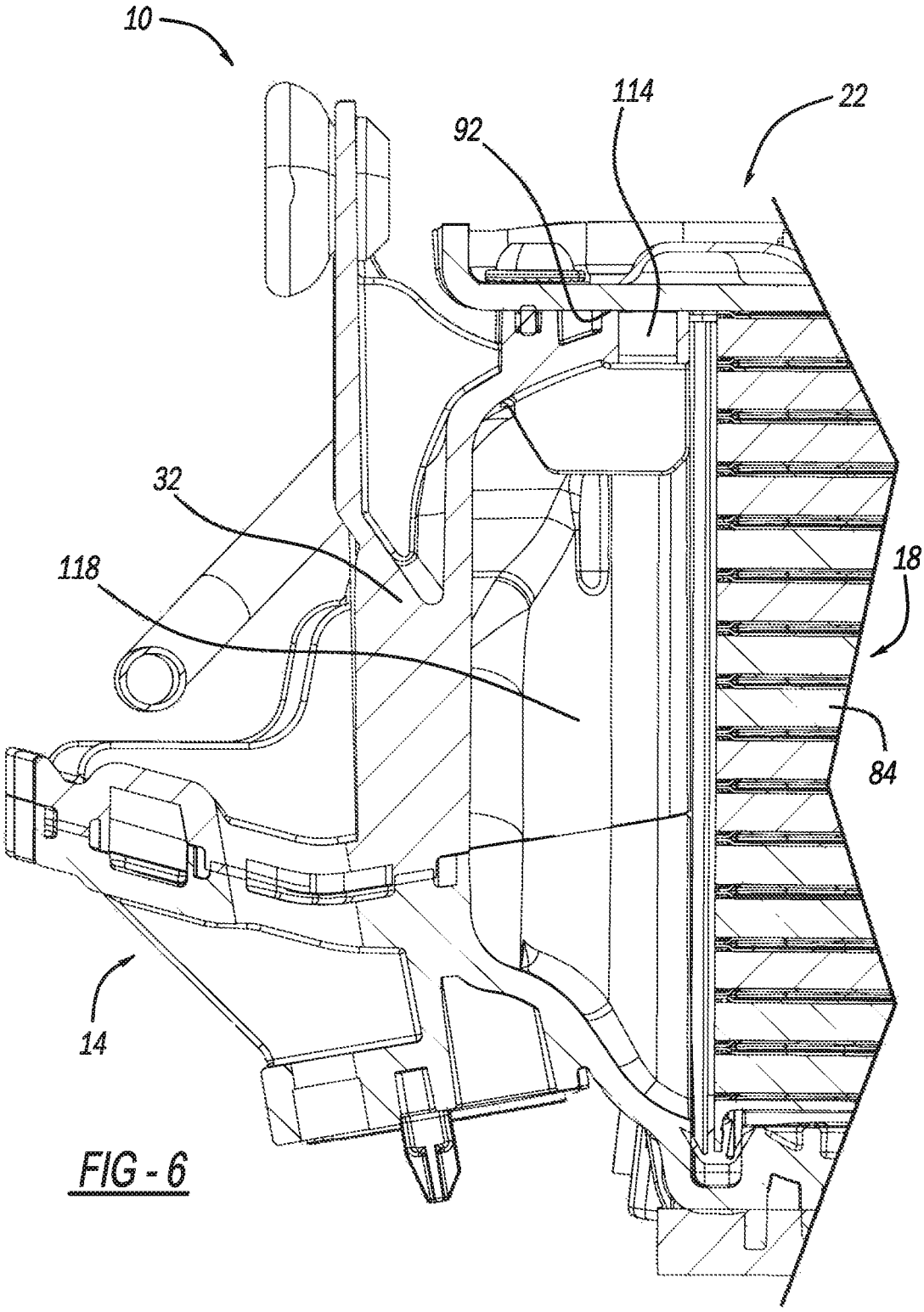
FIG. 6 is another partial sectional view taken along a section through another PCV distribution hole, PCV manifold and CAC top plate and sealing flange in accordance with the principles of the present application.
Figure 7:
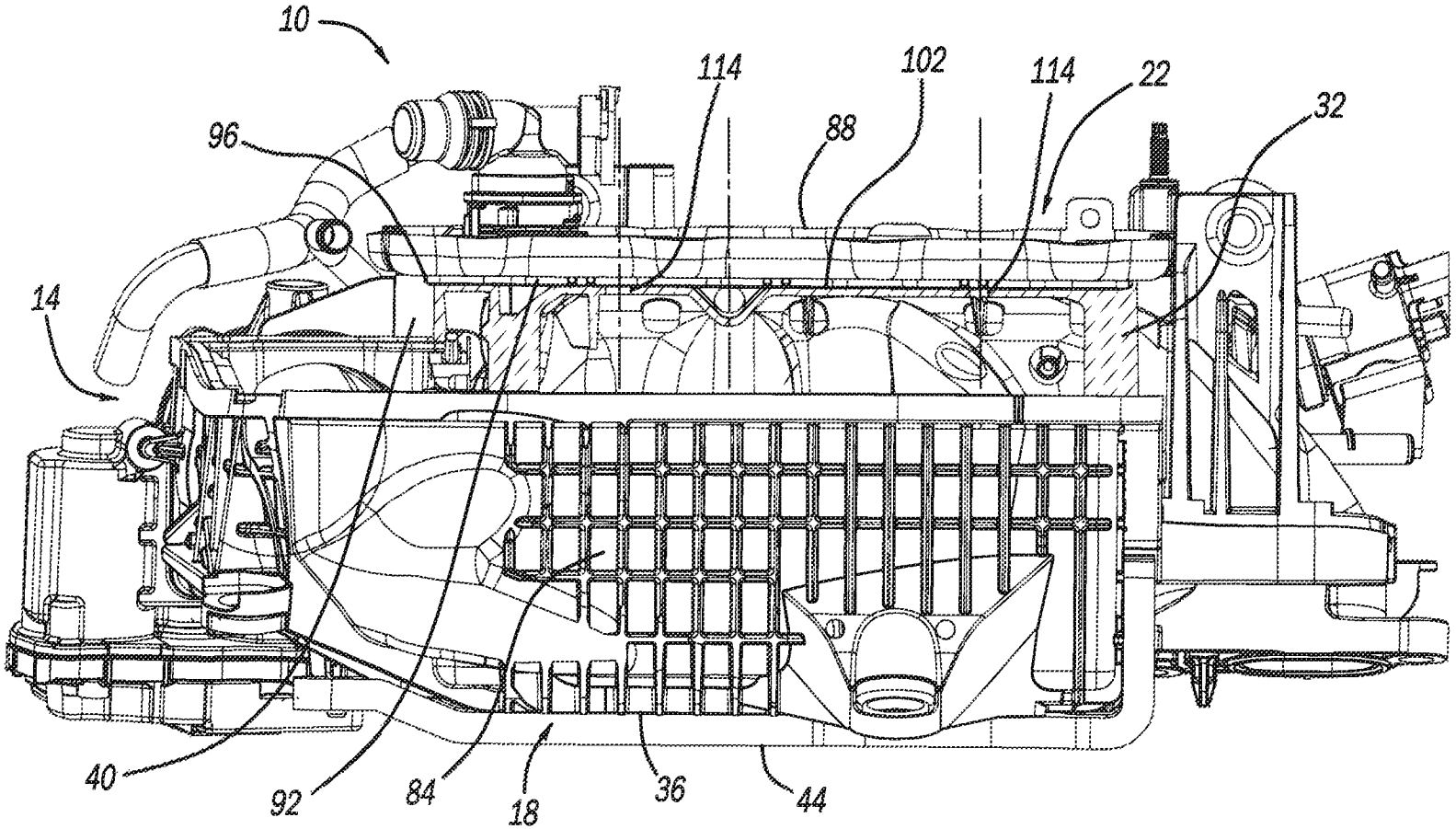
FIG. 7 is another partial sectional view taken along line 7-7 of FIG. 1 in accordance with the principles of the present application.

With particular reference to FIGS. 1-2, the intake manifold 14 will now be discussed and includes a housing 32 that defines a main chamber or plenum area 36. The main chamber 36 is defined by housing outer walls 40, a bottom housing wall 44 and an open upper or top end 48. One of the housing outer walls defines a connection 56 for the zip tube 60. The main chamber 36 is configured to receive the CAC 18 therein, in fluid communication with the zip tube 60 via connection 56, as will be further discussed below.

The CAC 18 includes a size and shape 72 that is complimentary to a size and shape 76 of an inside 80 of main chamber 36 such that a main body 84 of the CAC 18 is matingly received in main chamber 36. The CAC includes an integrated top cover plate 88 with an integrated sealing flange 92 which, as will also be discussed further below, forms a sealing cover to the main chamber 36 and the integrated PCV system 22 when the CAC 18 is sealingly secured to the housing 32 of intake manifold 14. In one exemplary implementation, the cover plate 88 is sized and shaped to form the sealed closure against a top perimeter surface 96 of the outer walls 40 defining the main chamber 36.

The integrated PCV system of intake manifold assembly 10 will now be discussed in greater detail. In one example implementation, the above-mentioned PCV manifold channel or chamber is identified at reference numeral 102 and is formed in the housing 32 of the intake manifold 14. In the example implementation illustrated in the various figures, the PCV chamber 102 is formed directly into the top perimeter surface 96 of one of the housing outer walls 40 such that the chamber 102 is open at its top end (like the main chamber 36) and enclosed on its sides and bottom by the respective housing outer wall 40, as shown for example in FIG. 2.

The PCV chamber 102 is in fluid communication with an inlet 106, which is also formed in housing wall 40 and is in fluid communication with an integrally formed external PCV port 110. The PCV chamber 102 is also in fluid communication with one or more distribution ports 114, which are defined by the housing wall 40 and are in fluid communication with plenum area 118 of intake manifold 14. Plenum area 118 is in communication with intake runners 122 of intake manifold 14 for distribution of the intake/PCV fluid stream to the combustion chambers of an associated cylinder head (not shown). On one example implementation, the external PCV port 110 is in direct fluid communication with the inlet 106, which is in direct fluid communication with PCV chamber 102, which is in direct fluid communication with distribution port(s) 114, which is/are in direct fluid communication with plenum area 118. In one example implementation, the above-discussed components of the integrated PCV system 22 are each integrally formed with the intake housing 32 as a one-piece integral unit forming the intake manifold 14.

In the example implementation illustrated, the integrated PCV chamber 102 is formed in the intake manifold housing 32 on an opposite side as an inlet of the zip tube 60. See, for example, FIGS. 1 and 2. For the implementation illustrated, the PCV manifold or chamber 102 includes five sides formed by the intake manifold housing 32, as discussed above. The open upper end or side 48 of the chamber 102 is enclosed by the sealing flange 92 of the top plate 88 of the CAC 18 when the CAC 18 is inserted into and sealingly secured/fastened to the intake manifold housing 32. Thus, the CAC sealing flange 92 advantageously seals both the intake manifold chamber 32 and the PCV chamber 102 when the CAC 18 is secured to the intake manifold 14, and does not require any extra components to do so. As such, this design reduces the cost and complexity of a PCV system, as well as potential leak paths and manufacturing time to assemble an engine with the integrated PCV system 22.

In an example of operation, PCV gas flows into the external port 110 and directly into the PCV manifold 102 via inlet 106. The PCV gas then flows from the manifold 102 directly into the distribution port(s) 114 for selective strategic placement of the PCV gas into the plenum area 118. The elongated PCV manifold/chamber 102 and distribution port(s) 114 formed in the intake manifold housing 32 provide(s) for PCV gases to be evenly distributed to the combustion chambers of the associated cylinder head or heads via plenum area 118 and intake runners 122.

In the example illustrated, the PCV manifold 102 includes two distribution ports 114. See, for example, FIGS. 2 and 4-7. These distribution ports 114 can be easily formed in the housing 32 during the manifold forming process, or post such process by a machining operation, for example. For the engine application illustrated, the distribution ports 114 are different sizes and are located at design specified locations along the manifold chamber 192 to provide the desired even distribution of PCV gases to all associated cylinders. It will be appreciated, however, that different numbers and sizes of ports 114, as well as different locations of the ports 114 are contemplated herewith.

The integrated PCV system of the present application provides an integrated PCV solution that reduces cost and complexity over known solutions, while also reducing required packaging space and potential leak paths. Further, the integrated PCV system advantageously utilizes the sealing flange of the CAC to seal the PCV manifold with a mere fastening of the CAC to the intake manifold. Moreover, the integrated PCV system provides for easy and cost effective adjustment of the distribution ports within the PCV manifold to accommodate different engine applications without having to redesign remaining portions of the intake manifold.

It will be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An intake manifold assembly for an engine of a vehicle, the assembly comprising:

an intake manifold housing defining a main chamber having perimeter walls, a closed bottom end and an open upper end;

a charge air cooler (CAC) positioned in the main chamber, the CAC having an upper cover plate defining a sealing flange; and an integrated positive crankcase ventilation (PCV) system, including:

a PCV chamber integrally formed into an upper surface of one of the perimeter walls, the PCV chamber having an open upper end at the upper surface of the one or more perimeter walls;

a PCV port integrally formed with the intake manifold housing and in fluid communication with the PCV chamber; and a distribution port defined by a wall of the PCV chamber and in fluid communication with an outlet plenum of the intake manifold;

wherein upon securing the CAC to the intake manifold housing, the sealing flange provides a sealed closure for the intake manifold main chamber and the PCV chamber.

2. The intake manifold assembly of claim 1, wherein the PCV port is in direct fluid communication with the PCV chamber and the PCV chamber is in direct fluid communication with the distribution port.

3. The intake manifold assembly of claim 2, wherein the distribution port is in direct fluid communication with the outlet plenum.

4. The intake manifold assembly of claim 1, wherein the PCV chamber includes two distribution ports, each of a different diameter for evenly routing PCV gas to intake runners of the intake manifold.

5. The intake manifold assembly of claim 1, wherein the upper cover plate and sealing flange are integrally formed with the CAC as a one-piece unit.

6. The intake manifold assembly of claim 1, wherein a portion of the one perimeter wall separates the PCV chamber and the main chamber.

7. The intake manifold assembly of claim 1, wherein upon securing the CAC to the intake manifold housing, the sealing flange seals against the upper surface of the one perimeter wall to thereby enclose the open upper end of the PCV chamber with the sealing flange.

8. An intake manifold assembly for an engine of a vehicle, the assembly comprising:

an intake manifold housing defining a main chamber having perimeter walls, a closed bottom end and an open upper end;

a charge air cooler (CAC) positioned in the main chamber, the CAC having an upper cover plate defining a sealing flange;

an integrated positive crankcase ventilation (PCV) system, including:

a PCV chamber integrally formed into an upper surface of one of the perimeter walls, the PCV chamber having an open upper end at the upper surface of the one or more perimeter walls;

a PCV port integrally formed with the intake manifold housing and in fluid communication with the PCV chamber; and a distribution port defined by a wall of the PCV chamber and in fluid communication with an outlet plenum of the intake manifold;

wherein upon securing the CAC to the intake manifold housing, the sealing flange provides a sealed closure for the intake manifold main chamber and the PCV chamber; and a connection for a zip tube, which is on an opposite side of the intake manifold housing as the integrated PCV system.

* * * * *